US005441374A

United States Patent [19]

Kosanke et al.

[11] Patent Number: 5,441,374

[45] Date of Patent: Aug. 15, 1995

[54] APPARATUS FOR FEEDING STRIPS COATED WITH A FUSION ADHESIVE ON ONE OF THEIR SURFACES TO AN ADVANCING TRANSPORT UNIT

[75] Inventors: Olaf Kosanke, Darmstadt; Sven Fischer; Helmut Domes, both of Stuttgart; Karin Röhrig, Wolfschlugen; Jürgen Weiblen, Münsingen-Dottingen, all of Germany

[73] Assignee: Eastman Kodak Company, Rochester, N.Y.

[21] Appl. No.: 149,879

[22] Filed: Nov. 10, 1993

[30] Foreign Application Priority Data

Nov. 24, 1992 [DE] Germany ..... 42 39 388.4

[51] Int. Cl.[6] ..... B42C 9/00

[52] U.S. Cl. ..... 412/11; 412/13; 412/37; 83/363; 83/650; 242/562.1

[58] Field of Search ..... 412/11-13, 412/36, 37, 900, 902; 242/562, 562.1; 83/363, 367, 650; 156/360, 362

[56] References Cited

U.S. PATENT DOCUMENTS

| | | | |
|---|---|---|---|
| 3,776,081 | 12/1973 | Becker | 83/650 X |
| 3,953,277 | 4/1976 | Kuhns | 412/900 X |
| 4,797,048 | 1/1989 | Doery | 412/11 |
| 4,825,622 | 5/1989 | Nigg | 83/650 X |
| 4,840,320 | 6/1989 | Shigeta et al. | 242/562.1 X |
| 5,052,873 | 10/1991 | Parker et al. | 412/13 |

FOREIGN PATENT DOCUMENTS

| | | |
|---|---|---|
| 0186080 | 12/1985 | European Pat. Off. . |
| 0412742 | 8/1990 | European Pat. Off. . |
| 2144101 | 3/1973 | Germany . |

*Primary Examiner*—S. Thomas Hughes
*Attorney, Agent, or Firm*—Larry P. Kessler

[57] ABSTRACT

Method and apparatus for feeding strips having a fusion adhesive coating on one of their surfaces to an advancing transport unit, in particular a sheet-stack binding apparatus where loose sheets are bound to form brochures or books. The method is carried out in that a thickness range of a sheet stack to be bound is associated with a specific width of a strip coated with a fusion adhesive, in that the association is effected in that the thickness of the sheet stack to be bound is determined or in that a selectable predetermined value is provided and in that the sheet-stack thickness value preselected or determined is used to control a drive mechanism (5, 6) which transfers the strip associated with the thickness range of the sheet stack to be bound from separate standby positions (7') of a number of strips (1c, 1d) of different widths to a handling position (12').

6 Claims, 1 Drawing Sheet

APPARATUS FOR FEEDING STRIPS COATED WITH A FUSION ADHESIVE ON ONE OF THEIR SURFACES TO AN ADVANCING TRANSPORT UNIT

BACKGROUND OF THE INVENTION

1. Field of the Invention

This invention relates, in general, to a sheet-stack binding apparatus for the binding of loose sheets to form brochures or books, and in particular to a method and apparatus for feeding strips coated with a fusion adhesive on one of their surfaces to an advancing transport unit.

2. Background Art

Sheet-stack binding apparatus for the binding of loose sheets to form brochures or books using strips coated with a fusion adhesive are described, for example, in DE-PS 2 144 101 as well as in the European Patents EP 0 186 080 and EP 0 412 742. A sheet stack held between clamping elements is pressed in the usual manner onto a fusion-adhesive coated strip which is arranged directly on or above a heated platen. As shown in EP 0 186 080, an adhesive element cut to be adapted to the sheet format can also be pressed by means of a pressure device against the spine of the sheet stack from below and then heated. Using heated lateral pressure elements, the adhesive strip is then folded and pressed against the cover sheets. As described in EP 0 412 742, an abutment can be provided to limit the contact pressure of a sheet stack pressed onto a heated platen so that the sheets are prevented from spreading during the adhesive binding. U.S. Pat. No. 4,797,048 also discloses an apparatus for binding loose sheets by means of fusion-adhesive coated strips, in which a heated platen is resiliently pressed against the strip with a predetermined pressure force in order to obtain an optimum adhesive bond. These known devices are disadvantageous in that only fusion-adhesive strips of one width can be handled unless the devices are converted for that purpose.

Other devices disclosed in the prior art include the Thermomatic-Binder 390 as illustrated in a brochure of the PLANAX Company (1992), which is capable of handling fusion-adhesive coated strips of different widths. However, the strip supply roll has to be exchanged for this purpose and the device has to be adjusted to each different thickness of the sheet stacks to be bound as well as to the different strip widths.

SUMMARY OF THE INVENTION

It is the object of this invention therefore to provide a method and apparatus which allow strips having a fusion adhesive coating on one of their surfaces and having different widths to be fed in an uncomplicated and speedy manner to a sheet-stack binding apparatus and thus the strip width to be adapted to the thickness of the sheet stack to be bound, without the device having to be reassembled or converted.

According to the method of this invention, the object is attained in that a specific strip width of a strip coated with a fusion adhesive is associated with a thickness range of a sheet stack to be bound, the thickness of the sheet stack to be bound being either determined or selected on the basis of a predetermined value. The value thus determined or the selectable predetermined value of the thickness of the sheet stack is advantageously used to control a driving means which transfers the strip associated with the thickness range of the sheet stack to be bound from a standby position, in which a number of strips of different widths are separately held, to a strip handling position. The thickness of a sheet stack to be bound is determined in a simple manner by opto-electronic sensing of the sheet stack.

According to this invention, the apparatus for feeding strips with a fusion adhesive coated on one of their surfaces to a sheet-stack binding apparatus comprises a number of strips of different widths held in a supply position on strip supply rolls, separate guide paths including strip driving means being provided for the transport of the strips from said rolls to a standby position as defined by an optical switch element. Downstream of the switch element and thus of the standby position of the strips, a threading element is provided which guides the strips to a common transport path adapted to accommodate the maximum strip width. The common transport path includes a chief strip driving means for further transport of the strip as well as an optical switch element and a switchable strip guide element which centers the strip in its transport path and guides it to a strip handling position as determined by a strip cutting unit.

Advantageously, the optical switch element sensing the leading strip edge and the chief strip driving means are connected with a control means which determines the strip path between the optical switch element and the strip cutting unit and feeds the corresponding value to an electronic storage means. The chief strip driving means consists of a stepping motor which is actuated by the optical element composed of a light barrier and is caused by the control means to count the steps and thus to determine the path length over which the strip has moved.

For centering the strip, the switchable strip guide element includes channels corresponding to different strip widths and movable into the strip path by actuating magnets. The magnets are actuated by signals generated by an electronic unit and controlling the strip driving means arranged in the individual guide channels.

BRIEF DESCRIPTION OF THE DRAWINGS

This invention will now be explained in further detail with reference to FIGS. 1 and 2 wherein.

DETAILED DESCRIPTION OF THE INVENTION

Figures 1, 2:
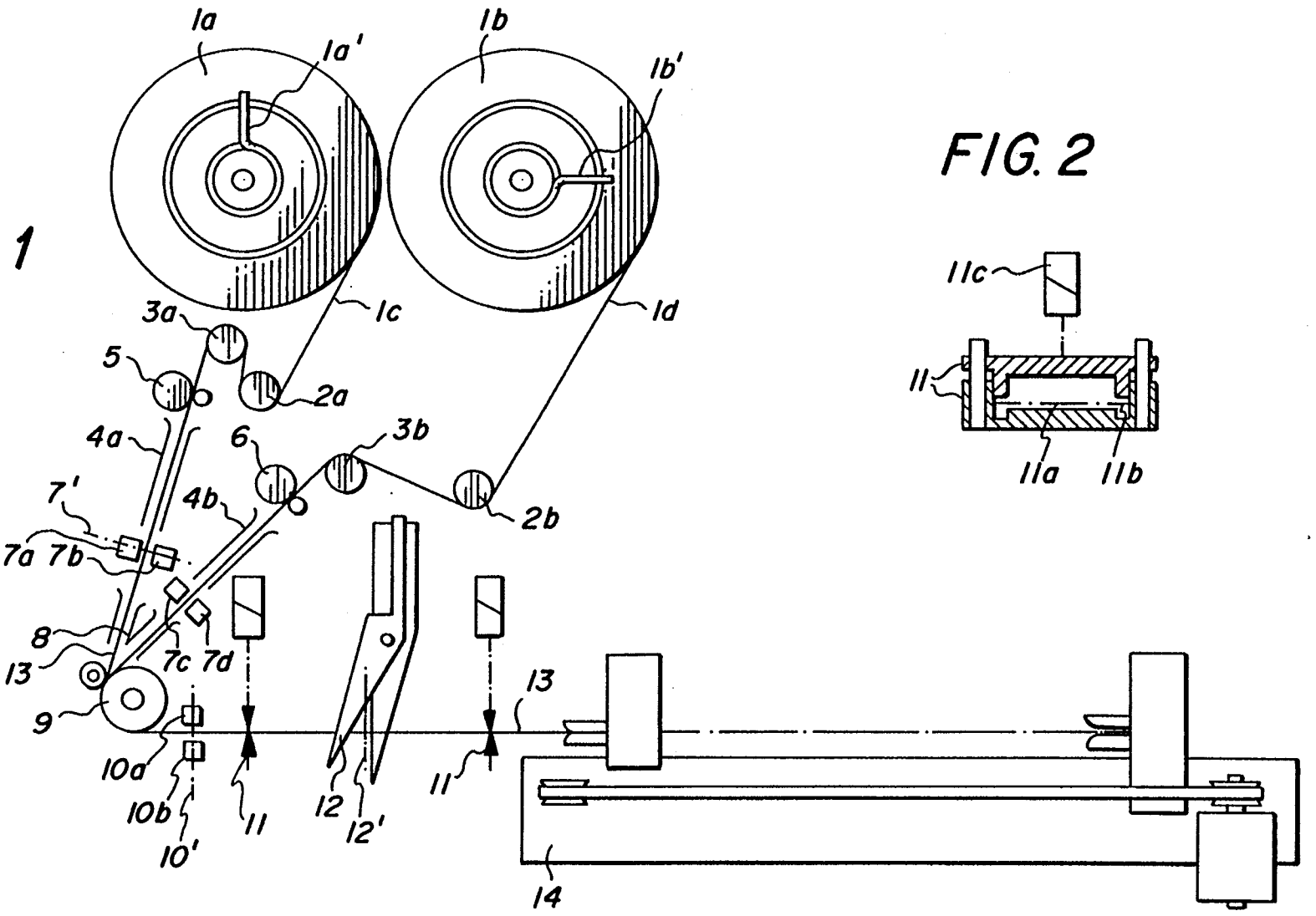
FIG. 1 is a schematic view of the binding strip-feeding apparatus without the binding apparatus.
FIG. 2 is a sectional view of the strip-guiding element of the apparatus according to FIG. 1.

As shown in FIG. 1, the binding strip-feeding apparatus comprises two strip supply rolls 1*a* and 1*b*, respectively, which are provided with winding springs 1*a'* and 1*b'* and on which strips unilaterally coated with a fusion adhesive and of different widths are tautly wound. Deflection rollers 2*a* and 3*a* and 2*b* and 3*b*, respectively, are arranged in the paths of the strips for guiding the strips unwound from the strip supply rolls 1*a* and 1*b* to a strip driving means 5 or 6 separately provided for each of the strips. The strip driving means 5 and 6 driven by direct-current motors have driving and pressure rollers between which each of the strips is guided and tautly tensioned by means of the winding springs of the strip supply rolls 1*a* and 1*b*, respectively.

Guide paths 4*a* and 4*b* each corresponding to a different strip width include at their ends optical switch elements 7*a* and 7*b* and 7*c* and 7*d* which consists of light barriers. A threading element 8 unites the separate guide paths 4*a*, 4*b* to form a common strip transport path 13 in which sequentially a chief strip driving means 9, another optical element 10*a* and 10*b* formed of a light barrier, a switchable strip guide element 11 as well as a strip cutting unit 12 are arranged. The chief strip driving means 9 consists of a stepping motor which like the direct-current motors 5 and 6 is connected to an electronic control means (not illustrated). Downstream of cutting unit 12, a further strip guide element 11 and a strip transport device 14 are arranged by means of which the strip coated with a fusion adhesive and cut to the length of the sheet stack to be bound is moved to any sheet-stack binding apparatus well known in the art (not illustrated).

As illustrated in FIG. 2, an element fixed to a magnet 11*c* is arranged on the switchable strip guide element 11 and includes two guide channels 11*a* and 11*b* at its lower side. By means of a signal which actuates one of the strip driving means 5 or 6, magnet 11*c* is switched such that a guide channel corresponding to a specific strip width is moved into strip path 13.

The method carried out by means of the binding strip-feeding apparatus can, be described as follows:

A sheet stack to be bound, which is arranged between holding elements in a sheet-stack binding apparatus (not illustrated), is sensed with respect to its thickness by opto-electronic means consisting, for example, of light barriers spaced at predetermined distances from each other. The value obtained is transmitted in terms of a signal to a central electronic unit controlling the device and being adapted to compare the widths of the strips 1*c* and 1*d*, respectively wound on the strip supply rolls 1*a* and 1*b* and the thickness of the sheet stack sensed. The strip widths are each associated with a predefined thickness range of the sheet stack to be bound. The thickness of the sheet stack can also be predetermined in a simple manner in the central electronic unit.

When the binding strip-feeding apparatus is in its initial position, the leading edges of the individual strips 1*c* and 1*d* are situated in the standby position 7' which is defined by light barriers 7*a*, 7*b*, 7*c* and 7*d* respectively arranged in the strip guide paths 4*a* and 4*b*. The result of the comparison of the values of the strip width and the thickness of the sheet stack causes the strip driving means 5 or 6, i.e. the direct-current motors, to transport the corresponding strip 1*c* or 1*d* of the width concerned from its standby position 7' into the strip handling position 12' as defined by strip-cutting unit 12. For this purpose, the corresponding strip, e.g. strip 1*c*, is shifted by means of motor 5 over threading element 8 until its leading edge is engaged by stepping motor 9 and transported by it to the handling position 12' as defined by strip-cutting unit 12. When the leading edge has reached the position fixed by means of the light barriers 10*a* and 10*b*, the drive roller of the direct current motor 5 is switched off by a magnet so that the strip is transported solely under the action of stepping motor 9. On the other hand, the controlling central electronic unit is caused to count the steps of motor 9 and thus to determine the path of movement of the strip up to handling position 12' and to transmit the corresponding value to an electronic storage means.

For cutting the strip to the length of the sheet stack to be bound, it is transported by stepping motor 9 to a gripping and pulling element located in the transport unit 14, which subsequently advances the strip in synchronism with the stepping motor 9 to a position which corresponds to the strip length predetermined in the central electronic unit for the sheet stack to be bound. The strip length to be cut is determined on the basis of the value of the strip length stored in the electronic storage means and the total strip length predetermined in the central electronic unit by counting of the further steps of motor 9.

When the predetermined strip length has been reached, the section where the strip is to be cut is below the cutting unit 12. The strip is cut and by means of the gripping and pulling element and other mechanical elements is fed to a binding apparatus (not illustrated) in which the strip is bonded to the sheet stack via its fusion adhesive layer in a manner known per se.

After the strip has been cut, its leading edge remains in the handling position 12' and can be used in the manner described for subsequent binding operations. A changeover to another strip is effected in that a signal is generated by the central electronic unit, which causes the motors 9 as well as 5 or 6 to return the strip from the handling position 12' to the standby position 7'.

The embodiment of the device just described is not confined to two supply positions as defined by the strip supply rolls, but can comprise more than two of such strip supply rolls. Since fusion-adhesive coated strips of different widths are thus made immediately available, the device need not be re-assembled or converted. Moreover, the folding spines of the books or brochures bound are always adapted to the thickness of the sheet stack to be bound.

The invention has been described in detail with particular reference to preferred embodiments thereof, but it will be understood that variations and modifications can be effected within the spirit and scope of the invention as set forth in the claims.

What is claimed is:

1. Apparatus for feeding strips having fusion adhesive coated on one of their surfaces to a sheet stack binding apparatus for binding loose sheets to form brochures or books, said strip feeding apparatus comprising:

a plurality of fusion-adhesive coated strips of different widths (1*c*, 1*d*) provided on respective strip-roll supplies (1*a*, 1*b*);

separate guide paths (4*a*, 4*b*) respectively including first drive means (5, 6) for transporting a strip from its strip-roll supply (1*a*, 1*b*) to a standby position (7') defined by optical switch elements (7*a*, 7*b*; 7*c*, 7*d*);

a threading element (8), located downstream of the respective standby positions (7'), for guiding the strips (1*c*, 1*d*) to a common transport path (13) adapted to accommodate the maximum width of said plurality of different widths; and in the common transport path (13), second drive means (9) for driving on of said strips along said common transport path (13), an optical switch element (10*a*, 10*b*) and a switchable strip guide element (11) such that said driven strip is centered in said transport path (13) while it is guided to a strip handling position (12') as defined by strip cutting unit (12).

2. The strip feeding apparatus according to claim 1, wherein said optical switch element (10, 10*b*), which senses the leading edge of said driven strip, and said second drive means (9) are connected with a control means which determines the length of the path of movement of the strip between the optical switch element (10*a,* 10*b*) and the strip cutting unit (12) and transmits the resultant value to an electronic storage means.

3. The strip-feeding apparatus according to claim 1, wherein said switchable strip guide element (11) has channels (11*a,* 11*b*) corresponding to the respective different strip widths, which channels can be moved into and aligned with the strip path (13) by means of actuating magnets (11*c*).

4. The strip feeding apparatus according to claim 3, wherein said magnets (11*c*) can be actuated by signals controlling the first drive means (5, 6).

5. The strip-feeding apparatus according to claim 1, wherein said optical switch elements (*7a, 7b; 7c, 7d;* 10*a,* 10*b*) provide light barriers.

6. The strip-feeding apparatus according to claim 1, wherein said first drive means (5, 6) arranged in the separate guide paths (4*a,* 4*b*) include direct-current motors and said second drive means (9) includes a stepping motor.

* * * * *